US006450341B1

(12) United States Patent
Krupa et al.

(10) Patent No.: US 6,450,341 B1
(45) Date of Patent: Sep. 17, 2002

(54) SHIPPING AND BAKING PACKAGE FOR FOOD ITEMS

(75) Inventors: Calvin S. Krupa, Medina; Patrick Boedigheimer, Ramsey, both of MN (US)

(73) Assignee: Oven Ready Foods LLC, Rogers, MN (US)

( * ) Notice: Subject to any disclaimer, the term of this patent is extended or adjusted under 35 U.S.C. 154(b) by 36 days.

(21) Appl. No.: 09/780,271

(22) Filed: Feb. 9, 2001

(51) Int. Cl.[7] ..... B65D 65/00

(52) U.S. Cl. ..... 206/497; 206/499; 206/562; 220/507; 426/106

(58) Field of Search ..... 206/497, 201, 206/203, 499, 503, 557, 562, 564; 220/507, 528, 529; 426/115, 119, 124, 128, 106, 108

(56) References Cited

U.S. PATENT DOCUMENTS

| | | | | | |
|---|---|---|---|---|---|
| 2,981,039 | A | * | 4/1961 | Pohl | 206/562 |
| 3,874,548 | A | * | 4/1975 | Buff, Jr. | 220/507 |
| 4,730,730 | A | * | 3/1988 | Clarkson | 206/497 |
| 5,899,353 | A | * | 5/1999 | Sabin et al. | 206/652 |
| 5,912,033 | A | * | 6/1999 | Ferguson | 426/124 |
| 6,019,221 | A | * | 2/2000 | Benja-Athon | 206/499 |

* cited by examiner

*Primary Examiner*—Luan K. Bui
(74) *Attorney, Agent, or Firm*—Thomas J. Nikolai; Nikolai & Mersereau, P.A.

(57) ABSTRACT

A packaging system in which food items can be frozen, stored, shipped, baked and served is disclosed. The packaging system includes a base, a pair of trays, a plurality of baking cups and a shrink wrap protective covering.

9 Claims, 5 Drawing Sheets

SHIPPING AND BAKING PACKAGE FOR FOOD ITEMS

BACKGROUND OF THE INVENTION

I. Field of the Invention

This invention relates generally to food packaging, and more particularly to a packaging system in which frozen batter can be stored, shipped and baked into finished, fresh from the oven, bakery goods such as brownies and muffins.

II. Description of the Prior Art

Various means have been used in the prior art to ship bakery products from one location to another. Finished bakery products are often transported in boxes, bags or cartons. Such boxes, bags and cartons serve three functions: (1) provide a convenient means for carrying bakery items; (2) prevent contamination of the bakery items; and (3) assist in keeping the bakery items fresh.

Similarly, unfinished bakery items have been shipped in a number of ways. Cake, brownie or muffin mixes have, for many years, been shipped in boxes or bags. Consumers, restaurant workers or the like blend the mixes shipped in this fashion with other ingredients such as water, milk, or eggs and then bake the product.

Various bakery products, such as cookies and rolls have been mixed at the factory, placed in a cardboard or plastic tube and then shipped to grocery stores or restaurants. In these situations, the product is generally removed from the package, placed on a cookie sheet, and then baked in the oven.

Problems exist with all three packaging methods outlined above. When bags, boxes and cartons are used to package fully baked items, care must be taken to avoid crushing of the package and its contents. Also, such items often lack the freshness and warmth that consumers, whether eating in a restaurant or at home, find desirable. Boxed or bagged mixes for cookies, brownies and cakes, when properly used, often provide the freshness and warmth desired. However, they require extra preparation time, the availability of ingredients other than the mixes, and mixing and baking utensils. This increases both preparation time and clean-up time. Even the prior art products that are fully mixed and ready to bake require the use of baking utensils. The product must be removed from the packaging and placed on a cookie sheet or the like before they can be baked.

SUMMARY OF THE INVENTION

The present invention overcomes all of the above-referenced problems with the prior art by providing a unique packaging arrangement in which bakery goods can conveniently be stored, frozen, shipped and even baked. Thus, the present invention not only provides a finished bakery product that is warm and fresh when served, but does so without the need for either any ring operations or any other utensils at the point of final baking. A further advantage of the present invention is that it provides a safe and effective method of transporting baked goods after they have been baked as well.

All of this is accomplished by providing a cheap and inexpensive package made up of four components: (1) a corrugated paper base; (2) a corrugated paper tray; (3) a plurality of paper cups; and (4) a shrink-wrap cover that completely surrounds the base, the tray, the cups and their contents. The base has a bottom, an upwardly extending sidewall projecting from the bottom, and an open top. A plurality of holes are cut through the bottom of the base to permit circulation of air throughout the package. The tray is designed to set within the base. It has a top and plurality of downwardly extending feet to hold the top a predetermined distance from the bottom of the base. The top of the tray has two sets of holes. One set is provided to permit proper circulation of air throughout the package. Each hole of the other set is used to receive and hold one of the cups in a spaced fashion from the other cups. The shrinkwrap plastic cover completely surrounds the package to prevent contamination of the contents during storage and shipping of the bakery products.

As suggested above, the present invention permits bakery products to be stored and shipped in a frozen fashion. The consumer or restaurant which receives the goods then simply removes the shrink-wrap cover and place the package in a conventional oven to bake the products. Once baking is complete, the products to be served right from the tray. This eliminates the need for any mixing, baking or serving utensils at a consumer or restaurant site. Alternatively, a distributor of bakery products can bake them in the package and then ship the entire package containing the bakery products to the consumer.

BRIEF DESCRIPTION OF THE DRAWINGS

The foregoing features objects and advantages of the invention will become more apparent to those skilled in the art from the following detailed description of a preferred embodiment, especially when considered in conjunction with the accompanying drawings in which.

DETAILED DESCRIPTION OF THE PREFERRED EMBODIMENTS

Figure 1:
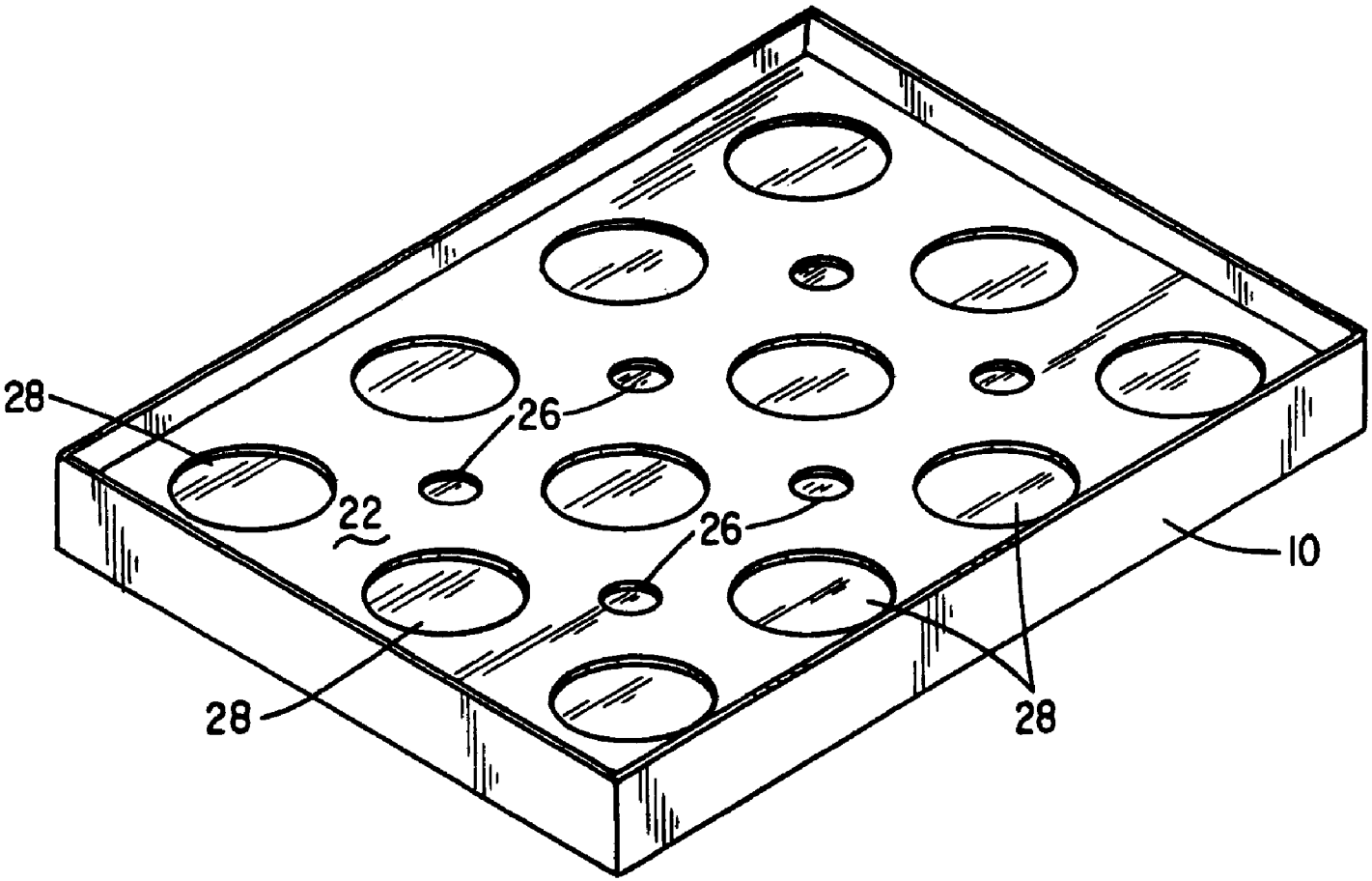
FIG. 1 is a perspective view of a fully assembled package made in accordance with the present invention.
Figure 2:
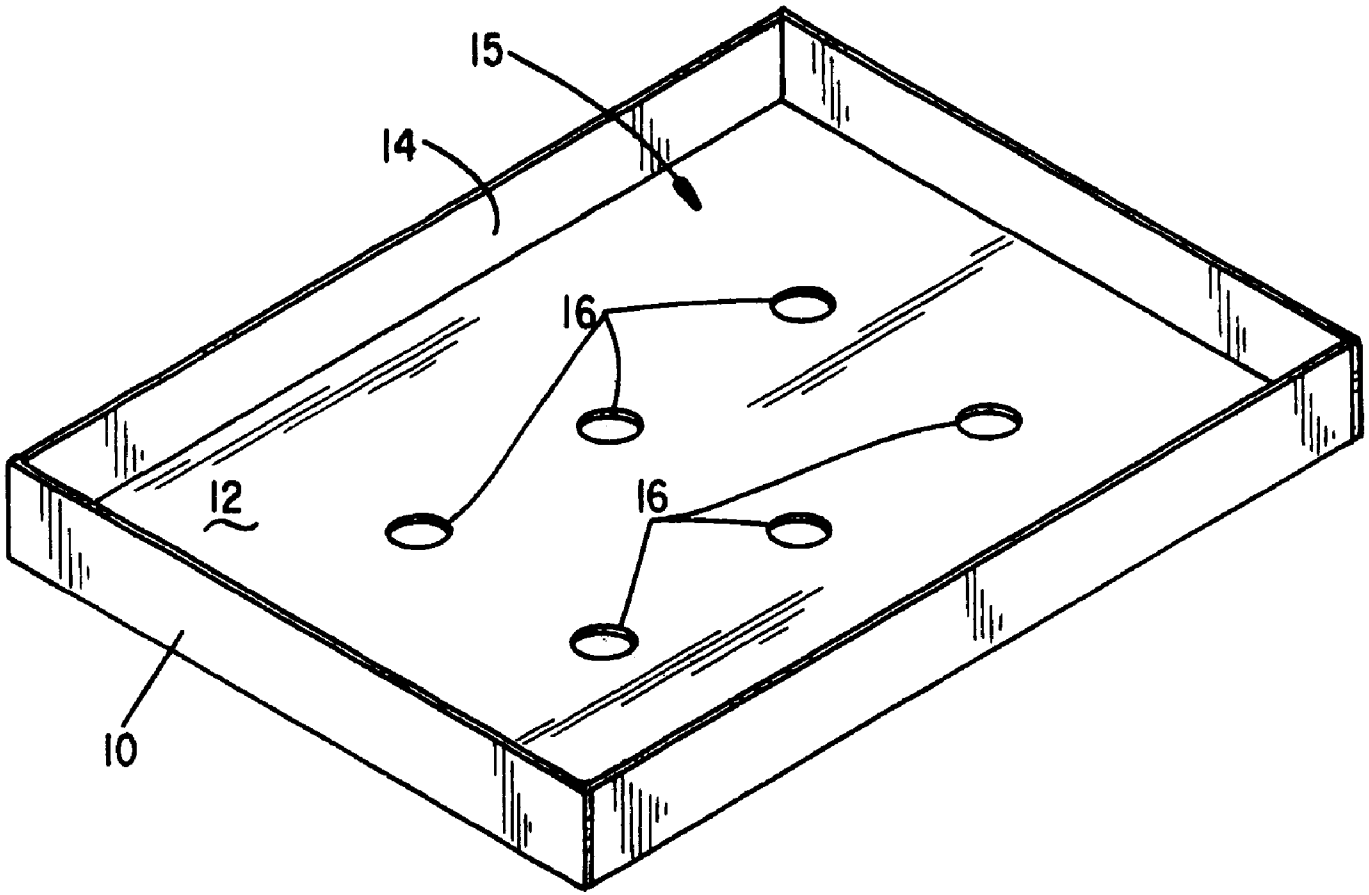
FIG. 2 is a perspective view of the base of the package shown in FIG. 1.

As shown best in FIG. 1 of the drawings, the preferred embodiment shown includes the following primary components: a base 10, a tray 20 and a shrink-wrap plastic covering 30. As shown in FIG. 2, the base includes a bottom 12, and an upwardly projecting sidewall 14 which surrounds the perimeter of the base. The top of the base is open. The bottom 12 and sidewall 14 cooperate to form a cavity 15. While the shape of the base shown is generally rectangular, it can have any of a number of shapes, including but not limited to, square, round, oval, trapezoidal, or hexagonal.

The base is preferably made of an untreated corrugated cardboard. The bottom 12 of the base 10 has a plurality of air holes 16 to provide air circulation and associated heat transfer during freezing or baking operations.

Figure 3:
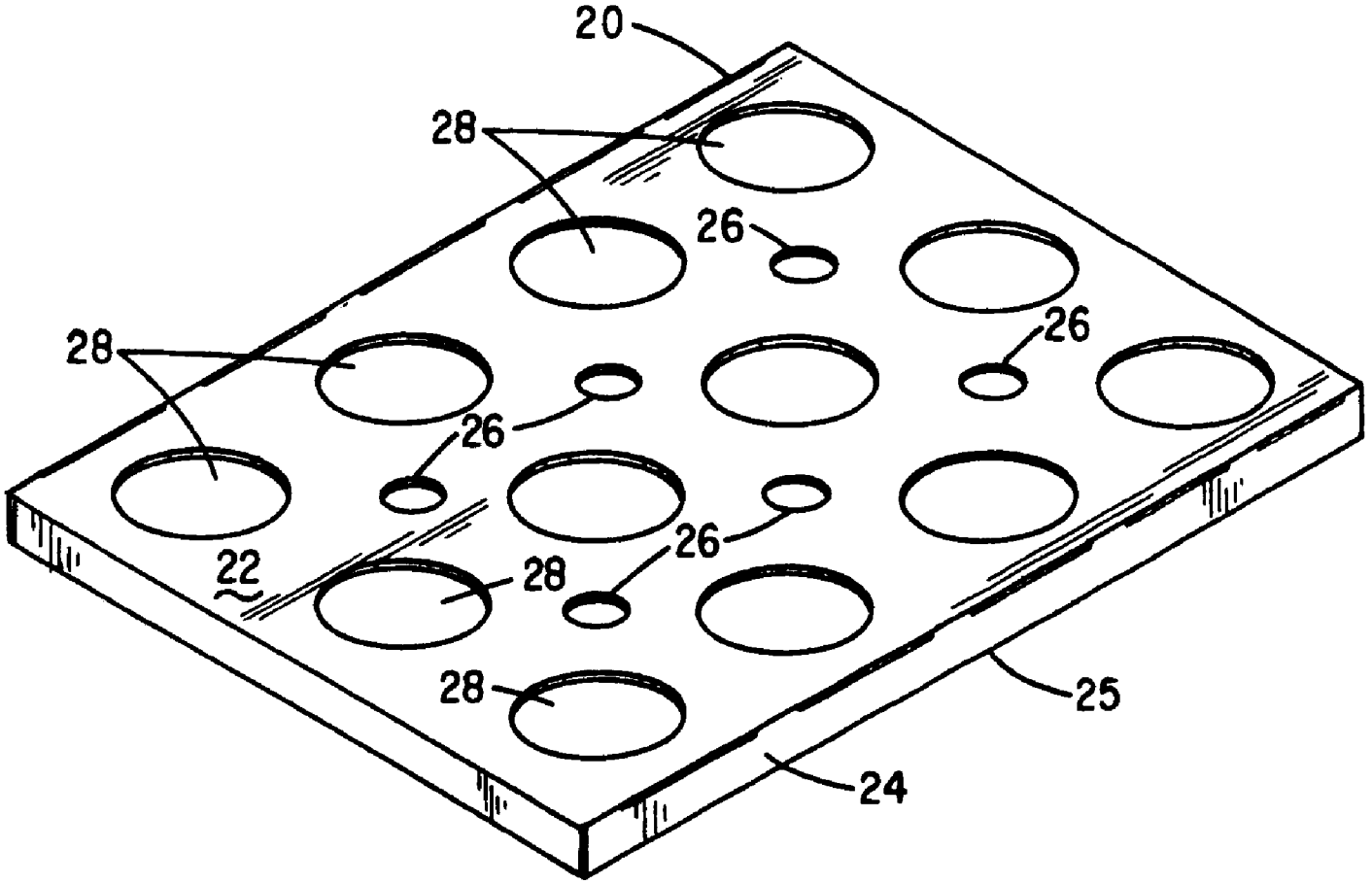
FIG. 3 is a perspective view of the tray of the package shown in FIG. 1.
Figure 4:
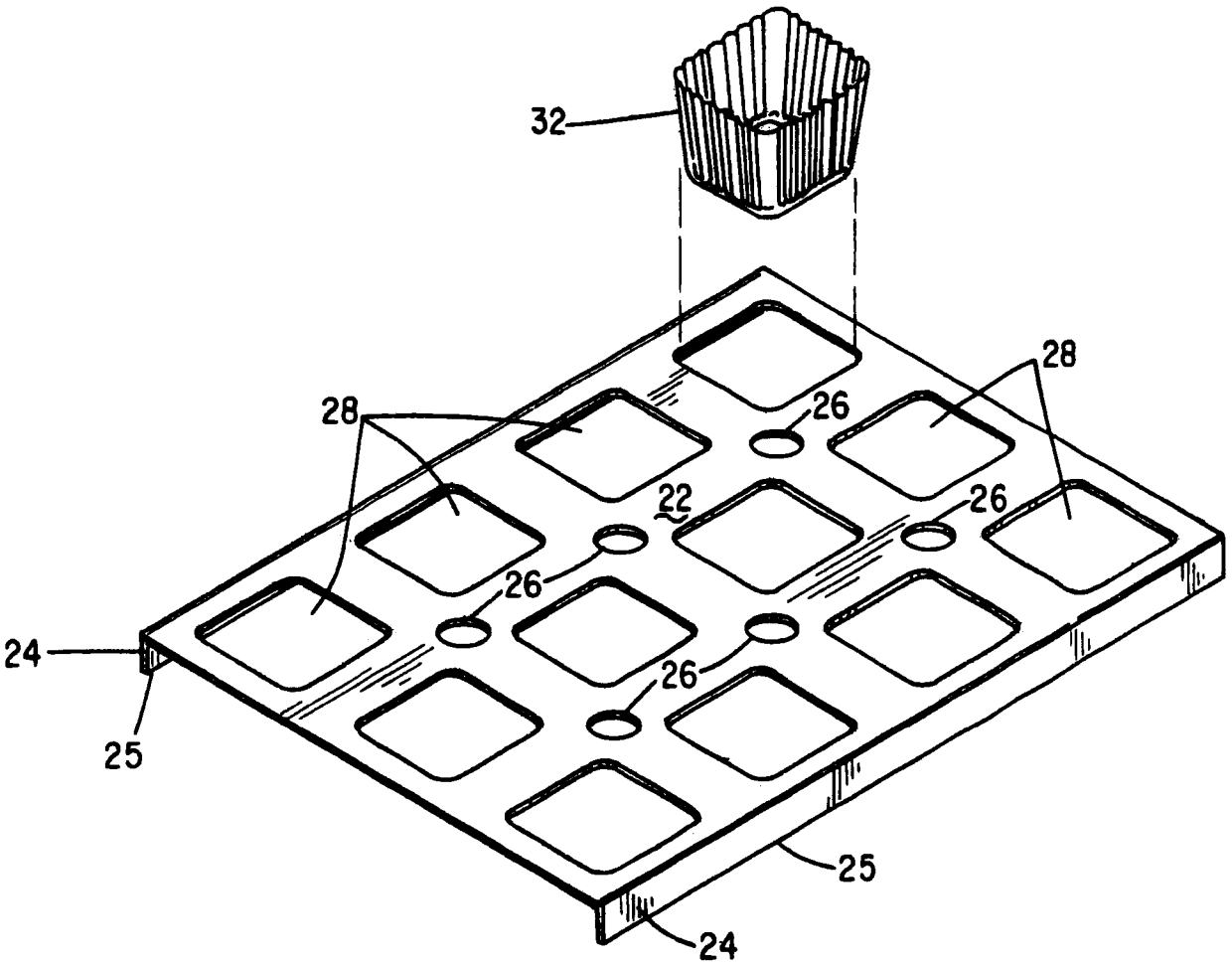
FIG. 4 is a perspective view of an alternative tray design for other types of baked goods.

FIGS. 3 and 4 best show two different embodiments of the tray 20. The tray 20 includes a top 22 and at least one downwardly projecting support comprising a foot 24. As shown in FIG. 4, two feet 24 are provided. The ends 25 of the feet 24 engage the bottom 12 of the base 10 to hold the top 22 of the tray 20 a desired height above the bottom 12 of the base 10. The tray 20 is also sized to fit within the cavity 15 of the base 10 as defined by the sidewall 14 of the base 10.

Figure 5:
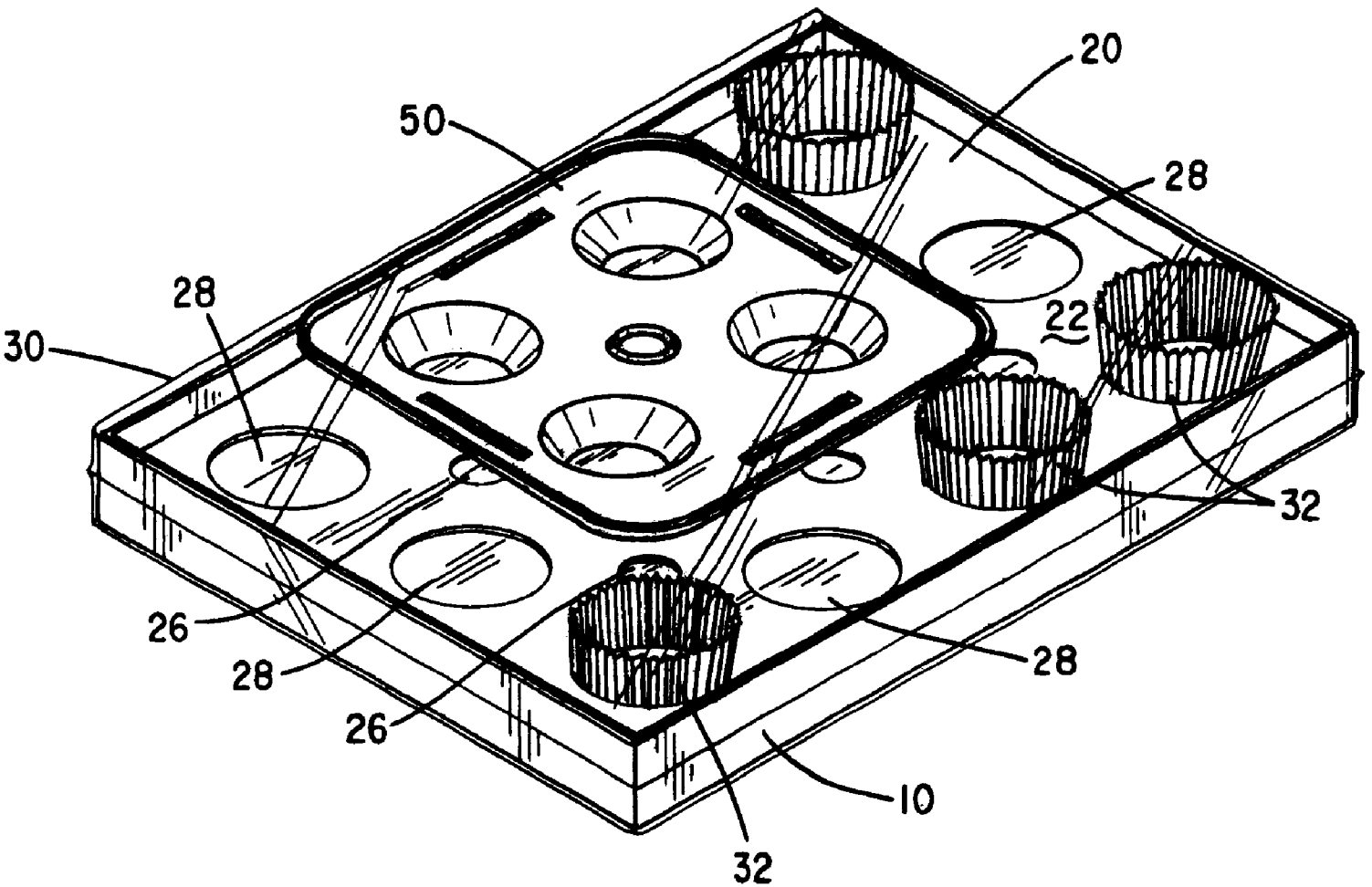
FIG. 5 is a perspective view of an alternative embodiment incorporating an additional separate bakery tray.

The top 22 of tray 20 has two sets of holes. As shown in FIGS. 1, 3 and 4 the smaller set of holes 26 are air holes. Like the air holes 16 in the base, the air holes 26 provide air circulation and heat transfer during freezing or baking operations. The larger set of holes 28 are sized and shaped to receive baking cups 32. In FIGS. 1, 3 and 5, the cup holes 28 are shaped to receive round cups 32. This configuration of the package would typically be used for muffins, cupcakes, or the like. In FIG. 4, the cup holes 28 are square and are designed to receive square cups 32. This configuration of the package would typically be used for brownies or small cakes. While round and square cup holes 28 are shown, other shaped holes and other shaped cups 32 can be used without deviating from the invention.

In constructing the tray, the goal is to provide adequate strength and support as well as maximum airflow. To ensure proper baking, the number of air holes 26 or their size can be increased. The same is true with respect to the construction of the base 10 and the air holes 16. To provide even greater air flow during baking, the tray 20 can be removed from the base 10 and then placed in the oven.

Another embodiment of the invention is shown in FIG. 5. In this embodiment, a separate smaller baking tray 50 is also provided. There may be times when a family or restaurant does not wish to bake the entire quantity of items in the package. By providing a separate, smaller baking tray 50, a user has the choice of baking some of the items now and continuing to store the rest for baking at a later time. The smaller baking tray 50 has one or more cups 52. These cups 52 are sized and positioned to (a) receive a baking cup 32; and (b) to fit within the cup holes 28 of the tray 20. Thus, the baking tray 50 can be conveniently shrink-wrapped with the base 10, tray 20, baking cups 32, and batter placed with the baking cups 32 for freezing, storage, shipment and/or baking.

To fully appreciate the advantages of the present invention, one needs to understand how it is typically used. First, a base 10 and tray 20 are assembled. Second, baking cups 32 are inserted into each of the cup holes 28. Third, batter for the baked goods is mixed and the desired amount of such batter is placed in each of the baking cups 32. Fourth, the base 10, tray 20, baking cups 32 and batter are placed in a freezer to freeze the batter. Typically, a nitrogen tunnel freezer would be used. Fifth, a shrink-wrap covering 30 is placed around the base to seal the package. A plurality of such packages, typically six, can then be placed in a carton for shipment to a restaurant or the like.

When a restaurant wants to serve bakery items that have been packaged as described above, a kitchen worker simply removes one of the packages for the carton, removes the shrink-wrap covering 30 from the package and places the rest of the packages and its contents in the oven. In about one half hour, the restaurant is ready to serve warm, fresh baked goods. As indicated above, it may sometimes be advantageous to remove the tray from the base and only place the tray 20, cups 32 and frozen batter in the oven.

Restaurants or homemakers may not wish to bake all of the items in the package at the same time. When the package is supplied with the separate, smaller baking tray 50, the baking tray 50 can be used to bake the desired number of items and the rest can be placed back in a freezer. As a cost saving measure, when six packages are shipped in a carton, one package (preferably the top package in the carton) will include the smaller baking tray 50. The rest will not.

Alternatively, a manufacturer of baked items can use the package to deliver completely finished product to a restaurant or the like. When doing so, the package is assembled, the batter is placed in the baking cups and the tray 20 is placed in an oven for the desired time and at the desired temperature. Once baking is complete, the tray 20 is removed from the oven and, if not already located with the base 10, placed with the base 10. The shrink-wrap covering 30 is applied and the product is ready to be shipped.

This invention has been described in considerable detail in order to comply with the patent statutes and to provide those skilled in the art with the information needed to apply the novel principles and to construct and use packaging incorporating the invention. However, it should be understood that the invention can be carried out in other ways and that various modifications can be made without departing form the scope of the invention.

What is claimed:

1. A shipping and baking package for food items comprising:

(a) a base having a bottom and an upwardly projecting sidewall proximate the perimeter of the base; said bottom and sidewall forming a cavity;

(b) a first tray at insertable into said cavity of said base, said tray having a top and at least one downwardly projecting support for holding the first tray a predetermined height above the bottom of said base, said first tray including at least one air hole through the top and at least one hole sized and shaped to receive a baking cup;

(c) at least one baking cup; and (d) a shrink-wrap covering surrounding said base and its contents.

2. A shipping and baking package for food items comprising:

(a) a base having a bottom and a sidewall projecting upwardly from said bottom to form a cavity, said bottom having a plurality of air holes there through;

(b) a first tray having a top and at least one foot, said first tray sized and shaped to fit within the cavity of the base and at least one foot of a sufficient length to hold the first tray at a pre-determined distance above the bottom of the base, said first tray having at least one air hole and a plurality of holes sized and shaped to receive a baking cup;

(c) a plurality of baking cups;

(d) a shrink-wrap covering surrounding the base and its contents.

3. The shipping and baking package of claim 2 further including a second tray having at least one cup sized and positioned to be insertable into one of said plurality of holes sized and shaped to receive a baking cup.

4. A shipping and baking package for food items comprising:

(a) a base made of untreated corrugated paper and having a bottom and an upwardly projecting sidewall, said bottom and sidewall forming a cavity;

(b) a first tray made of untreated corrugated paper and having a top sized and shaped to be positioned within the cavity of the base at a predetermined distance above the bottom of the base, said first tray having a plurality of holes, a first set of said plurality of holes being sized, shaped and positioned to serve as air holes, and a second set of said plurality of holes being sized, shaped and positioned to serve as baking cup holders;

(c) a baking cup inserted into each of said second set of said plurality of holes into which batter can be deposited for storage, shipping or baking;

(d) a shrink-wrap covering encapsulating said base and its contents.

5. The shipping and baking package of claim 4 when said base has an air hole positioned immediately beneath each of said second set of said plurality of holes in said tray.

6. A shipping and baking package for food items comprising:

(a) a base made of untreated corrugated paper and having a bottom and an upwardly projecting sidewall, said bottom and sidewall forming a cavity;

(b) a first tray made of untreated corrugated paper and having a top sized and shaped to be positioned within the cavity of said base at a predetermined distance above the bottom of the base, said tray having a first set of holes for permitting the passage of air and a second set of holes, (c) a second tray comprising a plurality of containers each of which being sized, shaped and positioned to fit within one of said holes of said second set of holes of said first tray;

(d) a plurality of baking cups into which batter can be deposited, and (e) a shrink-wrap cover surrounding the base and its contents.

7. The shipping and baking package of claim 6 wherein the number of containers of said second tray is less than the number of holes in said second set of holes of said first tray.

8. The shipping and baking package of claim 7 wherein one of said baking cups is placed in each of said containers of said second tray and in each of said holes of said second set of holes of said first tray not occupied by a container of said second tray.

9. The shipping and baking package of claim 6 wherein there is a separate air hole through the bottom of the base for and aligned with each of said second set of holes of said first tray.

* * * * *

UNITED STATES PATENT AND TRADEMARK OFFICE

CERTIFICATE OF CORRECTION

PATENT NO. : 6,450,341 B1 
DATED : September 17, 2002
INVENTOR(S) : Calvin S. Krupa et al.

It is certified that error appears in the above-identified patent and that said Letters Patent is hereby corrected as shown below:

Column 4,
Line 39, the word -- the -- should be inserted after the word "and".

Signed and Sealed this

Tenth Day of December, 2002

JAMES E. ROGAN
*Director of the United States Patent and Trademark Office*